US008434235B2

(12) United States Patent
Carter

(10) Patent No.: US 8,434,235 B2
(45) Date of Patent: May 7, 2013

(54) UTILITY KNIFE BLADE RELEASE MECHANISM

(75) Inventor: Phillip Noel Carter, Surrey (CA)

(73) Assignee: Gary McCallum, Kelowna, British Columbia (CA)

( * ) Notice: Subject to any disclaimer, the term of this patent is extended or adjusted under 35 U.S.C. 154(b) by 291 days.

(21) Appl. No.: 12/805,377

(22) Filed: Jul. 28, 2010

(65) Prior Publication Data

US 2012/0023758 A1 Feb. 2, 2012

(51) Int. Cl.
*B26B 29/06* (2006.01)

(52) U.S. Cl.
USPC ..... 30/293; 30/294; 33/42

(58) Field of Classification Search ..... 30/287, 30/293, 294, 339; 33/32.2, 32.3, 42; 83/745
See application file for complete search history.

(56) References Cited

U.S. PATENT DOCUMENTS

| | | | | |
|---|---|---|---|---|
| 1,100,878 | A | | 6/1914 | Higgins et al. |
| 1,445,546 | A | | 2/1923 | Olson |
| 1,577,569 | A | | 3/1926 | Donley |
| 2,090,183 | A | | 8/1937 | Capstick |
| 2,098,641 | A | | 11/1937 | Cook |
| 2,466,357 | A | | 4/1949 | Beith |
| 2,818,644 | A | | 1/1958 | Crawford |
| 2,835,037 | A | | 5/1958 | Middents |
| 3,174,225 | A | | 3/1965 | Abraham |
| 3,439,426 | A | | 4/1969 | Wilson |
| 4,176,572 | A | | 12/1979 | Pennington |
| 4,204,692 | A | | 5/1980 | Hoffman |
| 4,646,439 | A | | 3/1987 | Squires |
| 4,903,409 | A | | 2/1990 | Kaplan et al. |
| 4,977,673 | A | | 12/1990 | Altizer |
| 4,979,304 | A | | 12/1990 | Sprague |
| 5,033,197 | A | | 7/1991 | Irvello |
| 5,048,189 | A | | 9/1991 | Aurness et al. |
| 5,083,375 | A | | 1/1992 | Helm, Sr. |
| 5,197,195 | A | | 3/1993 | Aikens |
| 5,231,764 | A | | 8/1993 | Chang |
| 5,265,342 | A | | 11/1993 | Lang, Jr. |
| 5,309,642 | A | | 5/1994 | McGinnis |
| 5,404,647 | A | | 4/1995 | Prater |
| 5,406,711 | A | | 4/1995 | Graham |
| 5,471,750 | A | | 12/1995 | Deboi |
| 5,471,753 | A | * | 12/1995 | Rodrigues ..... 33/42 |
| 5,488,773 | A | | 2/1996 | Fletcher |
| 5,573,255 | A | | 11/1996 | Salpaka |
| 5,600,892 | A | | 2/1997 | Peugh et al. |
| 5,732,472 | A | * | 3/1998 | Praye ..... 33/42 |
| 5,979,063 | A | | 11/1999 | Pritz |

(Continued)

*Primary Examiner* — Hwei C Payer
(74) *Attorney, Agent, or Firm* — Antony C. Edwards

(57) ABSTRACT

A cutting assembly is slidably mounted on a T-Square. The T-Square may include a scale having multiple indicia for measured cutting based on the size of the wallboard sheet being cut. The cutting assembly is mounted on a slider which may be clamped at measured positions along the arm of the T-Square. The cutting assembly includes oppositely disposed knife blades which are slidably mounted in a housing and spring loaded on opposite sides of a pivot mount such that when not in use the cutting assembly is urged to level and rests with the two knife blades retracted. As the housing is rotated so as to lower one end, the corresponding knife blade extends from the housing to engage with and score or cut the surface of the wallboard material. The cutting tool may be rotated in the opposite direction to thereby extend from the housing the other blade of the pair of oppositely disposed knife blades.

16 Claims, 16 Drawing Sheets

U.S. PATENT DOCUMENTS

| | | | | |
|---|---|---|---|---|
| 5,996,237 | A | 12/1999 | Sanders | |
| 6,070,331 | A | 6/2000 | Dempsey | |
| 6,237,231 | B1 | 5/2001 | Jungmann et al. | |
| 6,357,120 | B1 | 3/2002 | Khachatoorian et al. | |
| 6,467,174 | B1 * | 10/2002 | Kotori | 30/293 |
| 6,513,246 | B2 | 2/2003 | Ping | |
| 6,553,674 | B1 | 4/2003 | Budrow | |
| 6,612,035 | B2 | 9/2003 | Brown et al. | |
| 6,629,370 | B1 * | 10/2003 | Sposato | 33/42 |
| 6,742,261 | B2 | 6/2004 | Ho | |
| 6,886,257 | B2 | 5/2005 | Chih | |
| 7,107,688 | B1 | 9/2006 | Critelli et al. | |
| 7,178,246 | B2 * | 2/2007 | McCallum | 30/293 |
| 7,305,770 | B2 | 12/2007 | Critelli et al. | |
| 2001/0020334 | A1 | 9/2001 | Wrobbel | |
| 2001/0029673 | A1 | 10/2001 | Brown et al. | |
| 2002/0014012 | A1 | 2/2002 | Hoffman | |
| 2002/0032969 | A1 | 3/2002 | Cardew | |
| 2004/0055168 | A1 | 3/2004 | Allen | |
| 2007/0157472 | A1 * | 7/2007 | Critelli | 30/162 |
| 2012/0023758 | A1 * | 2/2012 | Carter | 30/293 |
| 2012/0073152 | A1 * | 3/2012 | McGahan | 33/32.3 |

* cited by examiner 20
20a
12b
12a
12
42
42a
42b
42c
44
44a
26
34
36
48
48a
48b
50
46
46a
H
I
J
K 48a
48a
48b
48

48b
48

48a
48a
9b
9b 48b
48

UTILITY KNIFE BLADE RELEASE MECHANISM

FIELD OF THE INVENTION

This invention relates to tools and devices such as utility knives used for example for scoring or cutting wallboard or like material.

BACKGROUND OF THE INVENTION

It is known that when scoring or cutting (collectively herein cutting) wallboard materials such as gypsum board, wallboard, plasterboard, insulation board, or like materials particularly in construction applications that time to perform cutting operations can be reduced and quality of cut increased when using cutting tools referenced to an edge of the wallboard material as in the case of a T-Square guided knife. Cutting of wallboard needs to be quite accurate in most cases as the material is often used in finishing interiors of buildings where fit ultimately affects the quality and appearance of the finish. Furthermore the cutting of wallboard materials should be quick and easy to maximize installer productivity and reduce overall cost of installation.

In most cases, wallboard materials can be cut by first scoring the surface, and then bending the board along the score line so as to break the board. Scoring a long line of 4 feet, typical gypsum board width, or even longer lines of 8 to 12 feet or more can be difficult without a referenced guide. Long straight edges often get bent and malformed due to miss-handling during the course of normal construction work and transportation between job sites. Several attempts aimed at resolving this challenge have been made as shown in U.S. Pat. No. 6,629,370 issued to Sposato on Oct. 7, 2003, which teaches of a board cutter including a T-Square and a common utility knife mounted to a slider which rides along the long leg of the T-Square and is fixed at a position by means of a clamp mechanism as in a thumb screw. The common utility knife is connected to the slider by way of a pivotal pin, and clamped into a depth of cut position again using a thumb screw arrangement. The primary drawback of the Sposato patent is that is difficult to cut the full face of a wallboard from edge to edge as the T-Square runs out before the knife has scored the whole length of the surface. This is particularly evident when cutting a wallboard while it is standing on end as when leaning against a wall, the leading end of the head of the T-Square is blocked by the floor or ceiling preventing the knife from reaching the edges closest to the obstructing floor or ceiling. These draw-backs are addressed in my U.S. Pat. No. 7,178,246 which issued Feb. 20, 2007, entitled Wallboard Cutting Tool, and is incorporated herein by reference.

A further drawback of prior art utility knives or wallboard cutting knives is the difficulty in changing or reversing the cutting blades in the knife. It is an object of the present invention to provide an improved mechanism for holding and releasing such blades in utility knives or the like. In the prior art applicant is aware of United States Patent Publication No. US2007/0157472, published Jul. 12, 2007.

SUMMARY OF THE INVENTION

The present invention serves to improve the function and productivity of utility knives by providing an improved blade release and locking mechanism. An example, which is not intended to be limiting, is provided herein of a wallboard scoring and cutting tool having a dual extending and retracting blade cutting assembly slidably mounted on a T-Square.

The cutting assembly is mounted on a slider, which can be clamped at measured positions along the ruler arm of the T-Square for example according to a scale imprinted on the ruler arm. The cutting assembly includes oppositely disposed knife blades which are slidably mounted in a rocker housing. The rocker housing is spring loaded on opposite sides of a pivotal mount such that when not in use the cutting assembly is urged to level and rests with the two knife blades retracted.

The tool user engages the cutting device with the wallboard by pivoting the cutting device rocker housing down towards the wallboard material on the side opposite of the intended direction of travel of the T-Square. As the cutting device rocker housing is rotated so as to lower one end into its lowered operating position, the corresponding knife blade (for sake of reference referred to below as the first blade) located within the housing, which also serves as a handle, extends from the housing to engage with and score the surface of the wallboard material. The cutting tool is moved so as to slide along the surface of the wallboard material, guided by the fence of the T-Square riding along the edge of the wallboard material, until the T-square head encounters an obstacle or the end of the wallboard. The cutting tool is then released so as to be resiliently urged by the springs in the housing to return the housing back to its neutral level resting position, the first blade simultaneously retracting into the housing. The cutting tool may then be rotated in the opposite direction to thereby extend from the housing the second blade of the pair of oppositely disposed knife blades so as to engage and score the wallboard surface when slid in the opposite direction, thereby allowing the user of the tool to cut the full extent of the wallboard sheet from edge to opposite edge.

The utility knife blade release and locking mechanism according to one aspect of the present invention may be characterized as including a blade locking ball slide having at least one pocket formed thereon, at least one locking ball mounted alongside the ball slide, a ball slide, and switch slide retainer. The ball slide is slidably mounted in a blade carrier for sliding translation relative to the blade carrier. The blade carrier is adapted to hold a blade having at least one ball receiving aperture therein alongside the locking ball so as to sandwich the locking ball between the blade, when held in the blade carrier, and the ball slide.

The ball slide is positionable into ball locking and ball unlocking positions. The pocket is mis-aligned with the locking ball when the ball slide is in the ball locking position so that the locking ball is held in registery into the ball receiving aperture of the blade, when held in said blade carrier. The pocket is aligned with the locking ball when the ball slide is in the ball unlocking position so that the locking ball is received into the pocket. The locking ball is thus released from the aperture in the blade so that the blade is unlocked and removable from the blade carrier.

The switch slide retainer is selectively positionable into a ball slide engaging position and into a ball slide disengaged position. In said ball slide engaging position the switch slide retainer engages the ball slide so as to bias the position of the pocket between the ball unlocking and ball locking positions.

DETAILED DESCRIPTION OF EMBODIMENTS OF THE INVENTION

Figure 1:
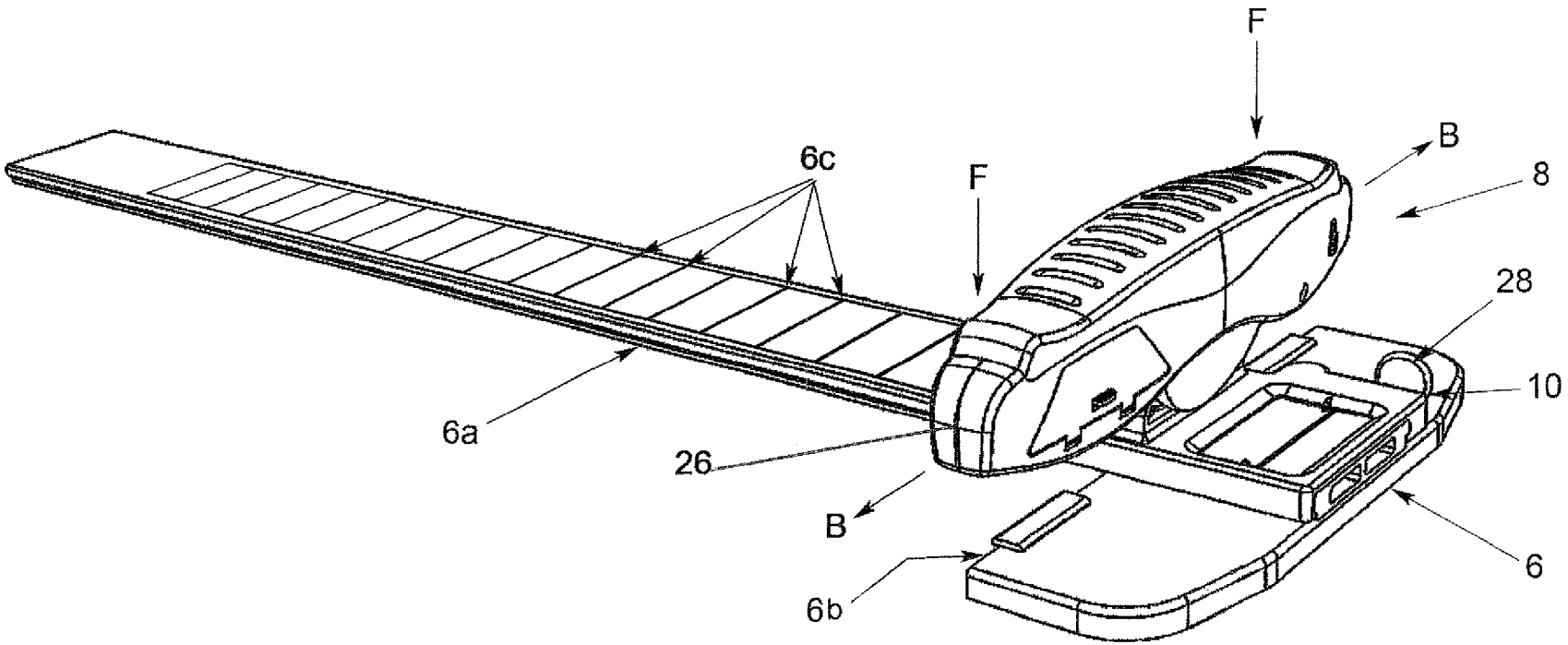
FIG. 1 is, in perspective view, a wallboard cutting tool containing the utility knife blade release mechanism according to the present invention.
Figure 1A:
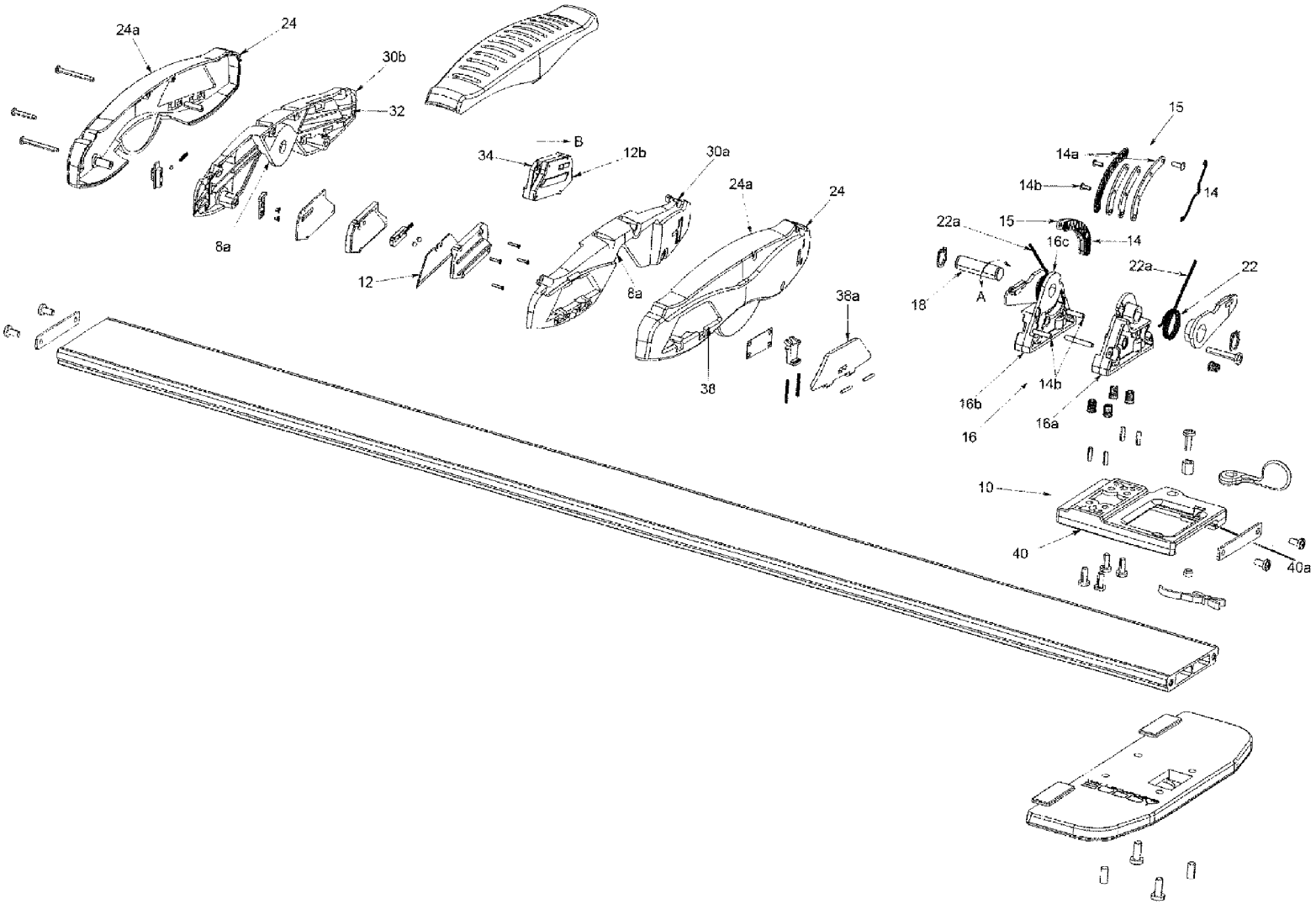
FIG. 1*a* is, in exploded perspective view, the wallboard cutting tool of the FIG. 1.
Figure 2:
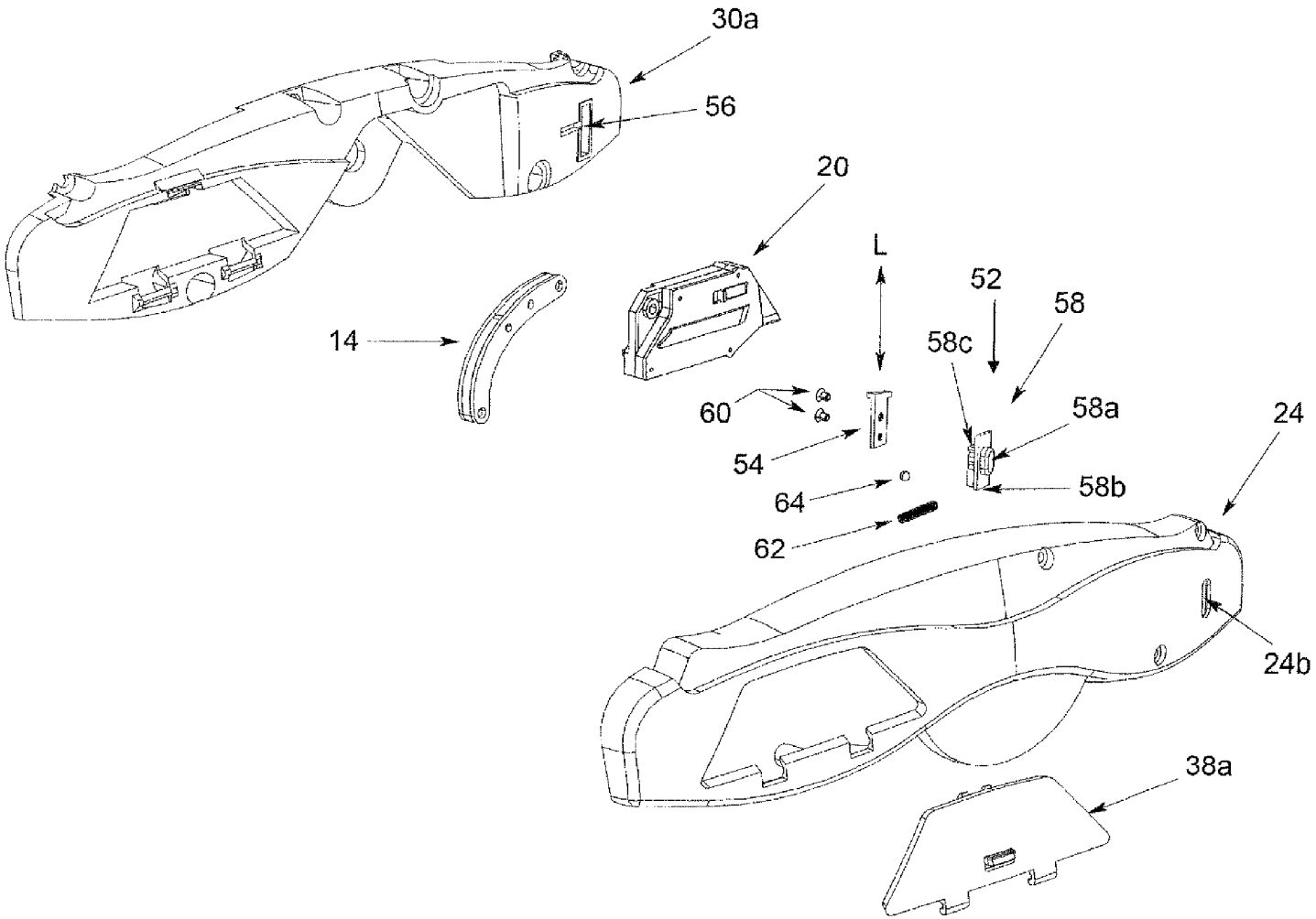
FIG. 2 is an enlarged view of a portion of FIG. 1*a*.
Figures 3A, 3B, 3C, 3D:
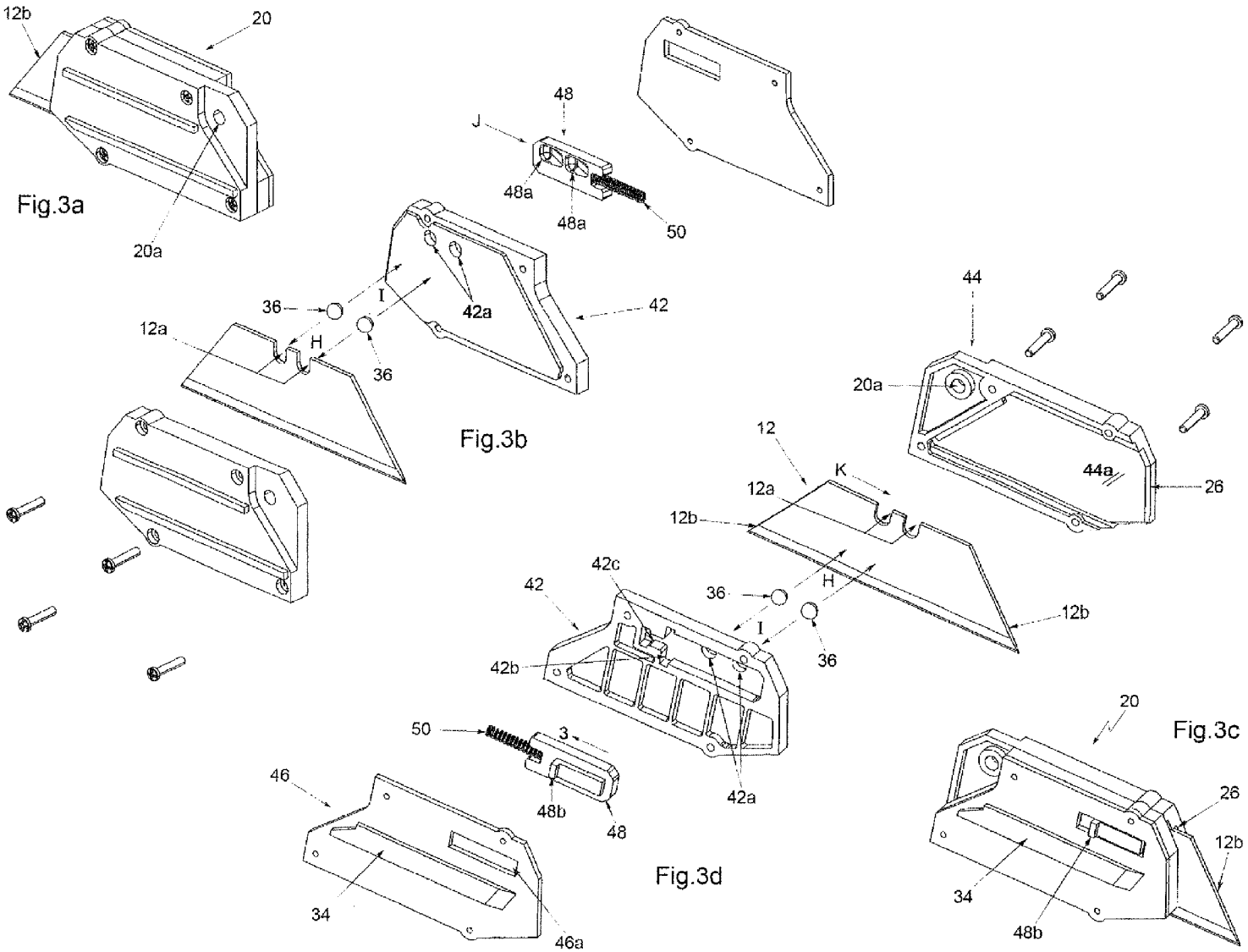
FIG. 3*a* is, in a first side perspective view, a blade carrier and blade of the cutting tool of FIG. 1.
FIG. 3*b* is, in exploded perspective view, the blade carrier and blade of FIG. 3*a*.
FIG. 3*c* is, in opposite side perspective view to that of FIG. 3*a*, the blade carrier and blade of FIG. 3*a*.
FIG. 3*d* is, in exploded perspective view, the blade carrier and blade of FIG. 3*c*.
Figure 4:
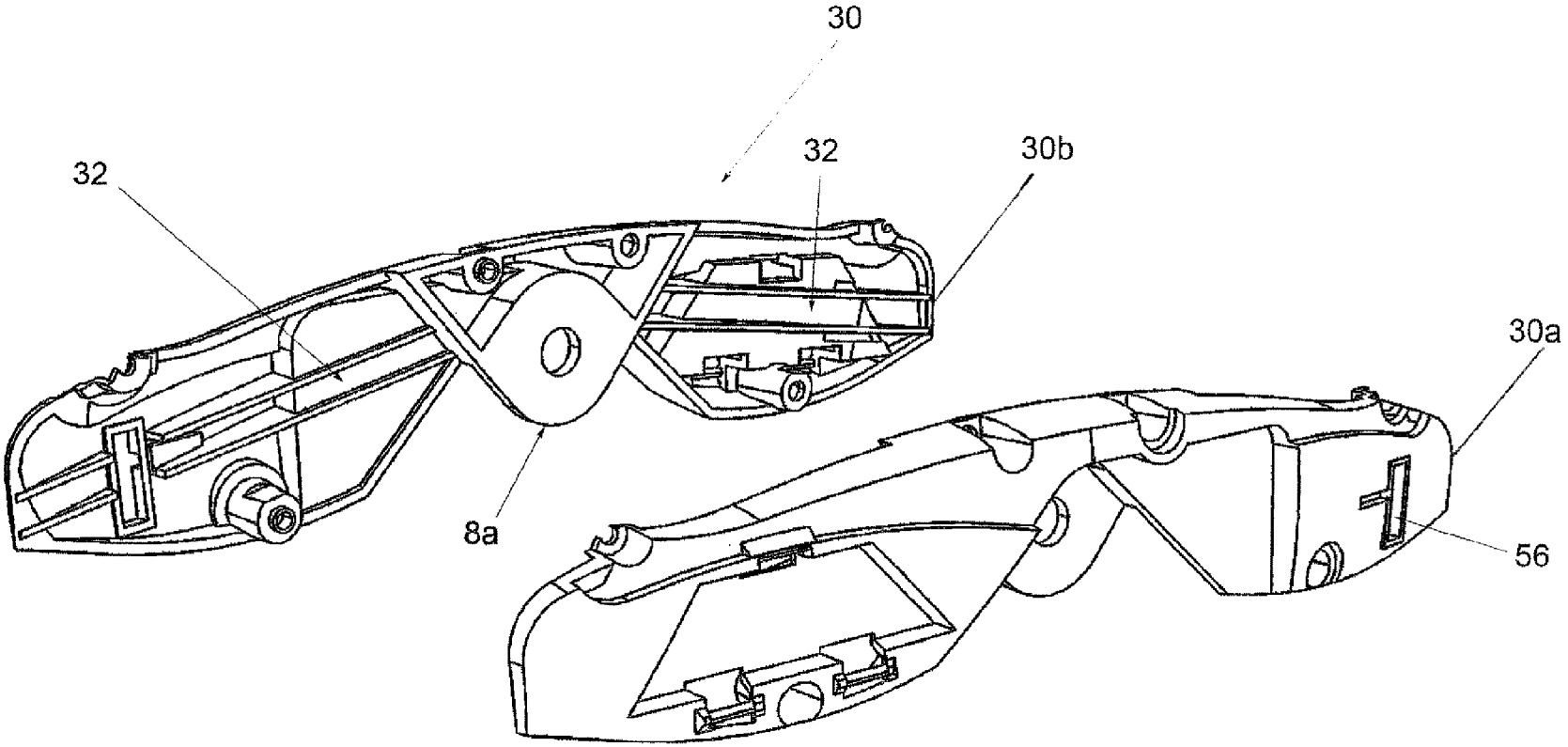
FIG. 4 is, in exploded partially cut-away view, the cutting head of the cutting tool of FIG. 1.
Figure 5A:
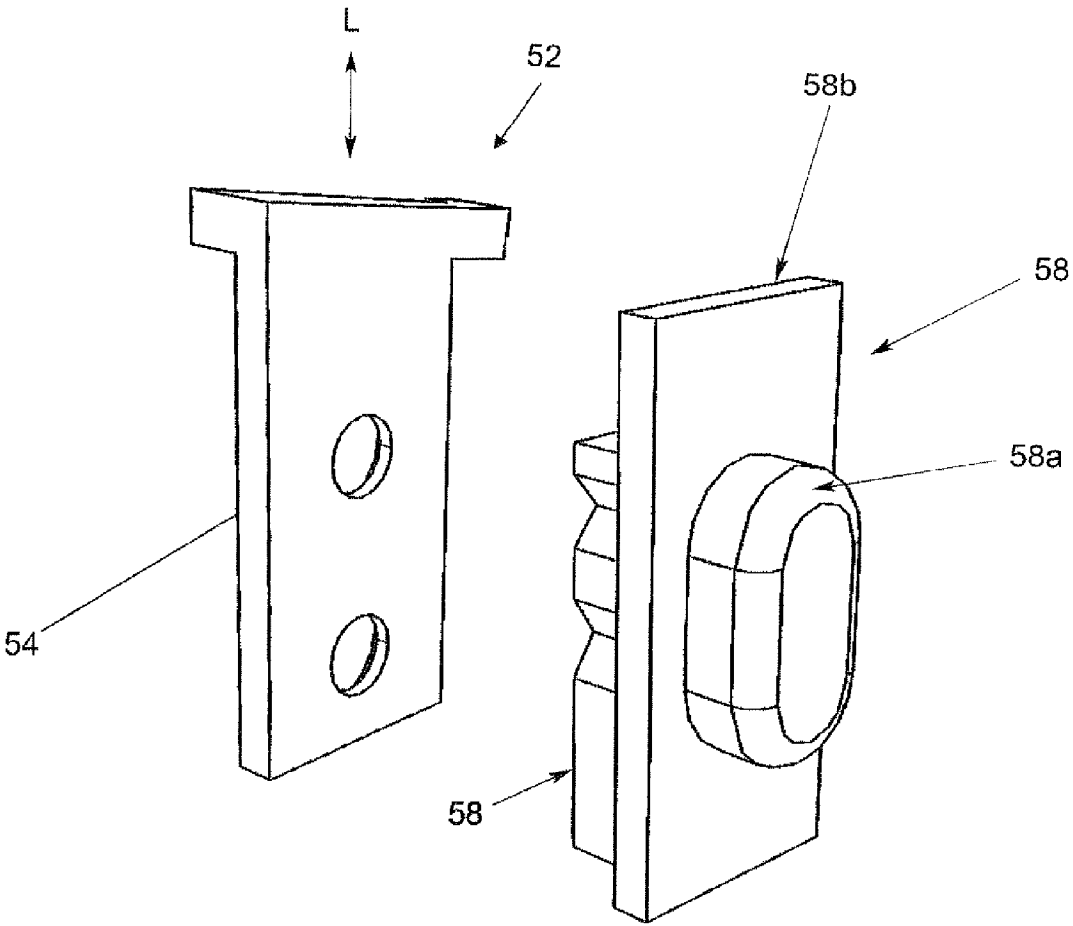
FIG. 5*a* is, in a first side perspective exploded view, the slide switch mechanism of the blade release mechanism according to the present invention.
Figure 5B:
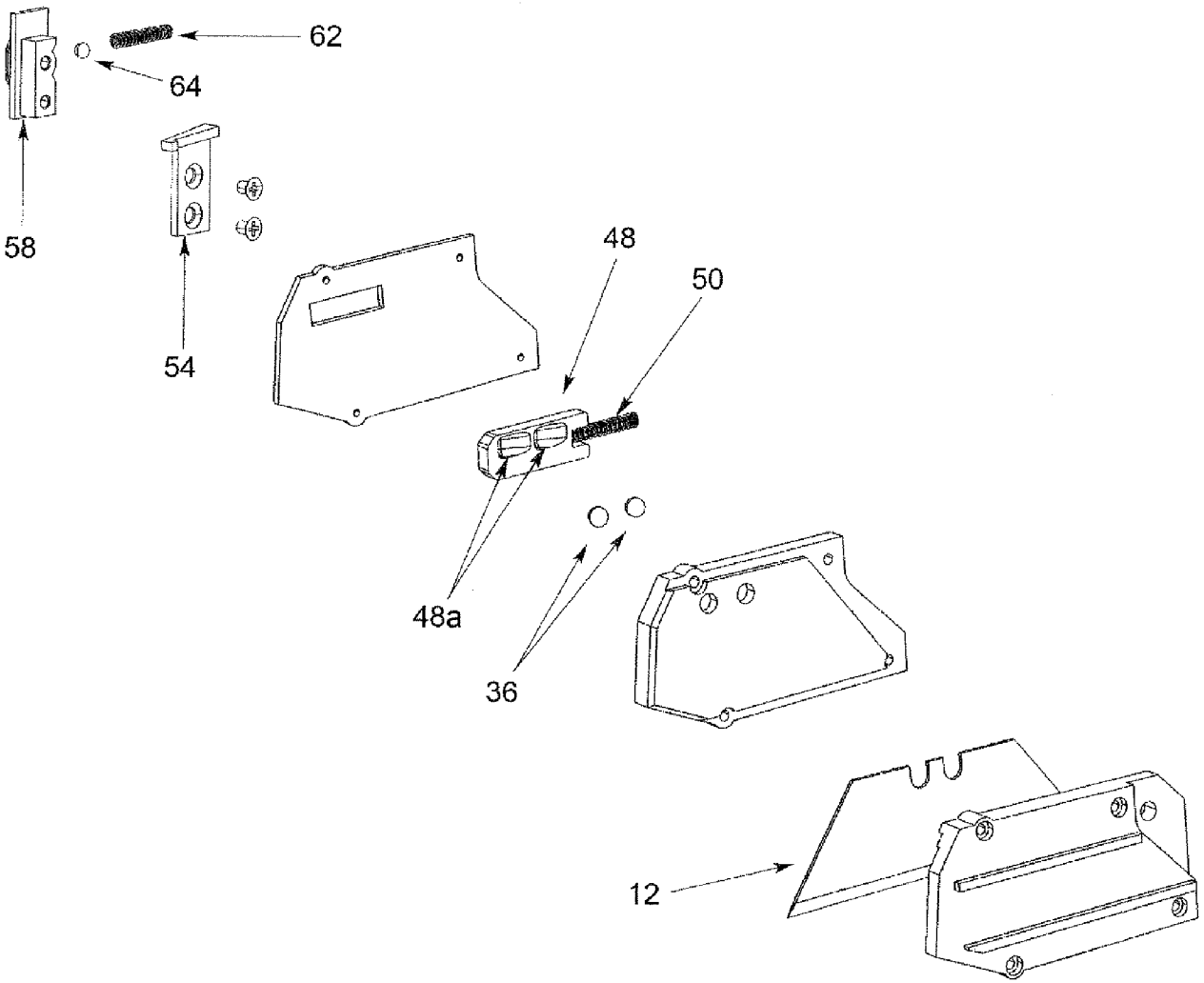
FIG. 5*b* is, in opposite side perspective exploded view, the blade release mechanism of FIG. 5*a* and the corresponding blade carrier and blade.
Figure 6:
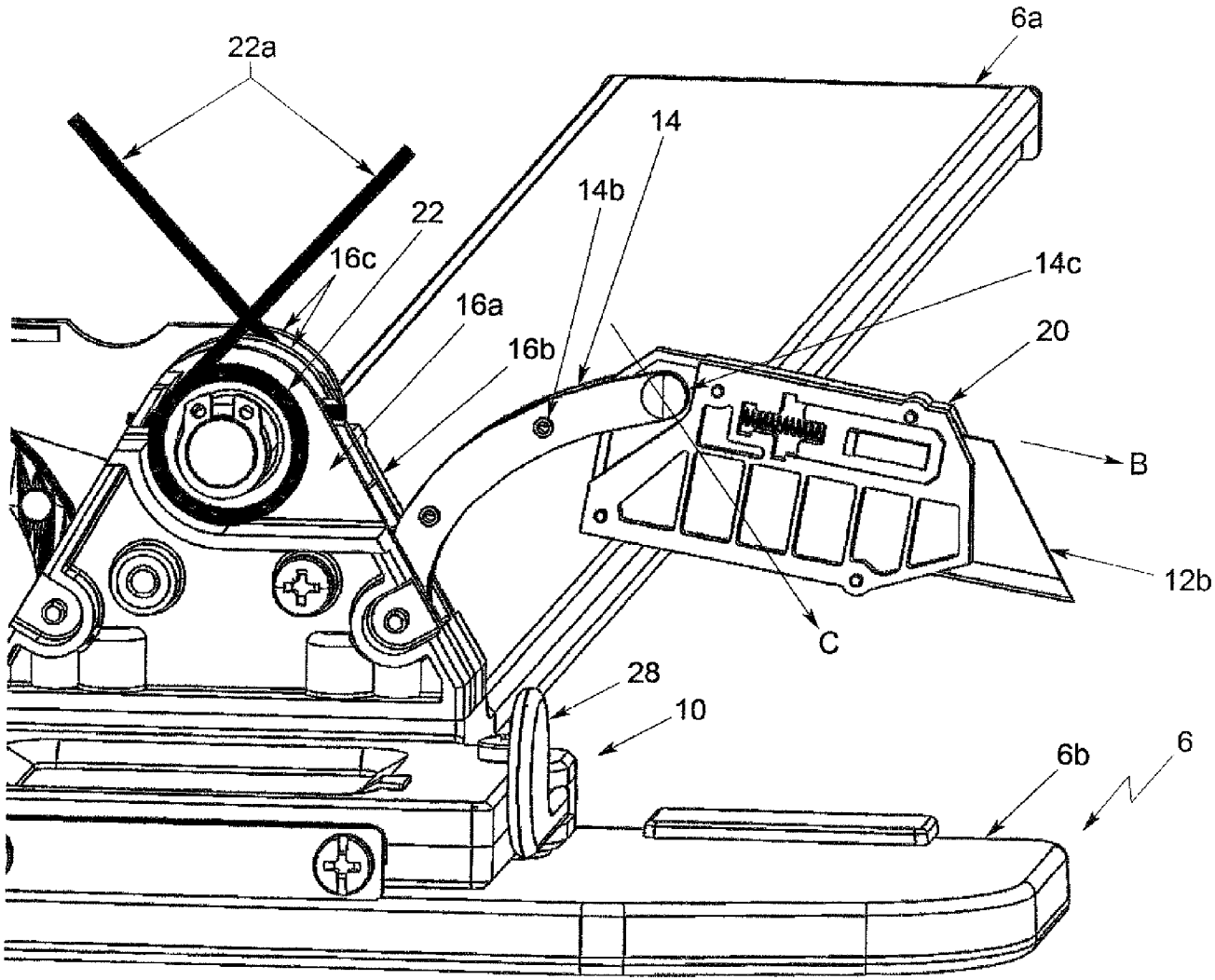
FIG. 6 is, in partially cut-away rear perspective view, the base, and one linkage and blade carrier of the cutting tool of FIG. 1.
Figure 7:
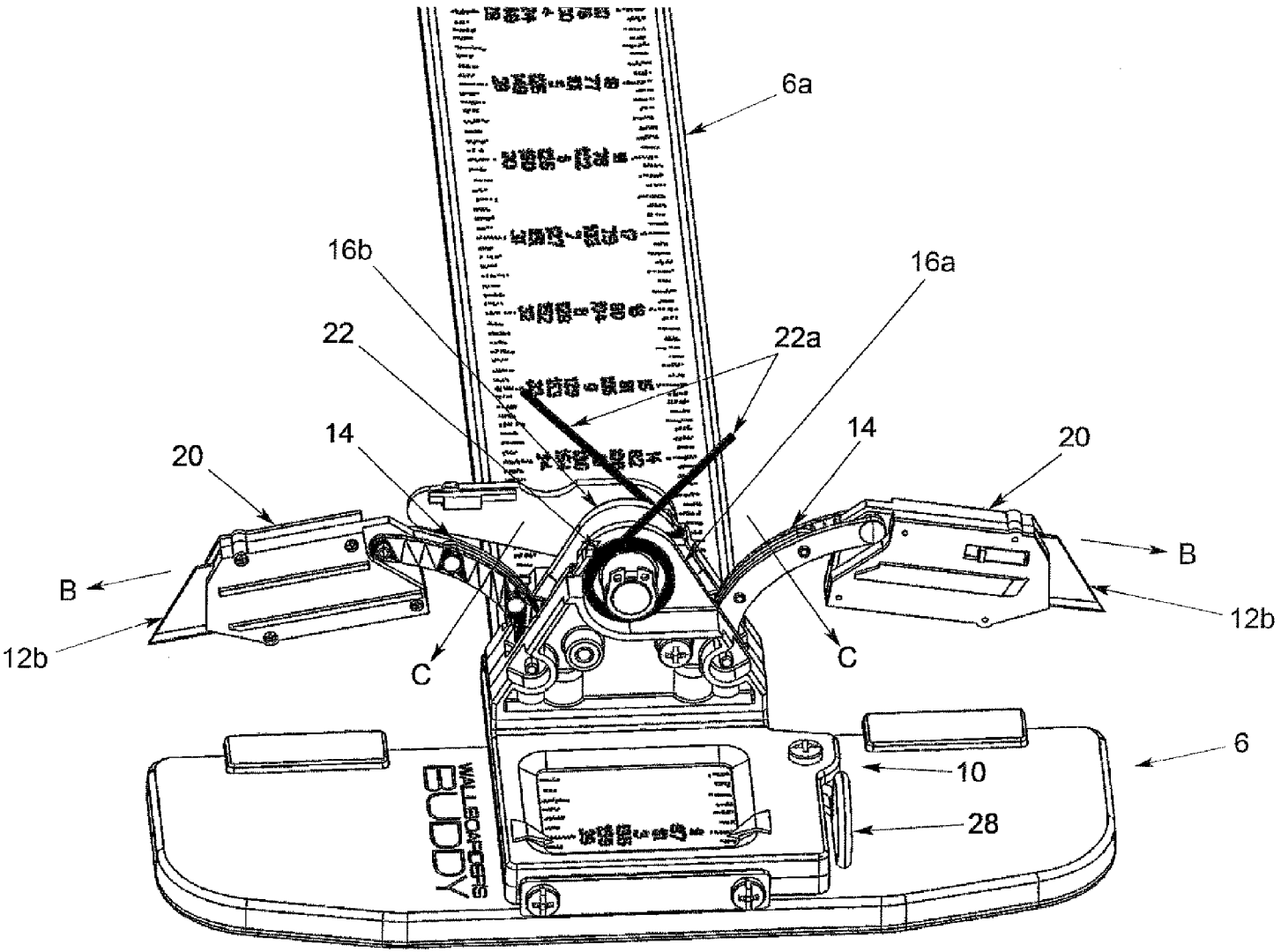
FIG. 7 is, in top partially cut-away view, the cutting tool of FIG. 1.
Figure 8:
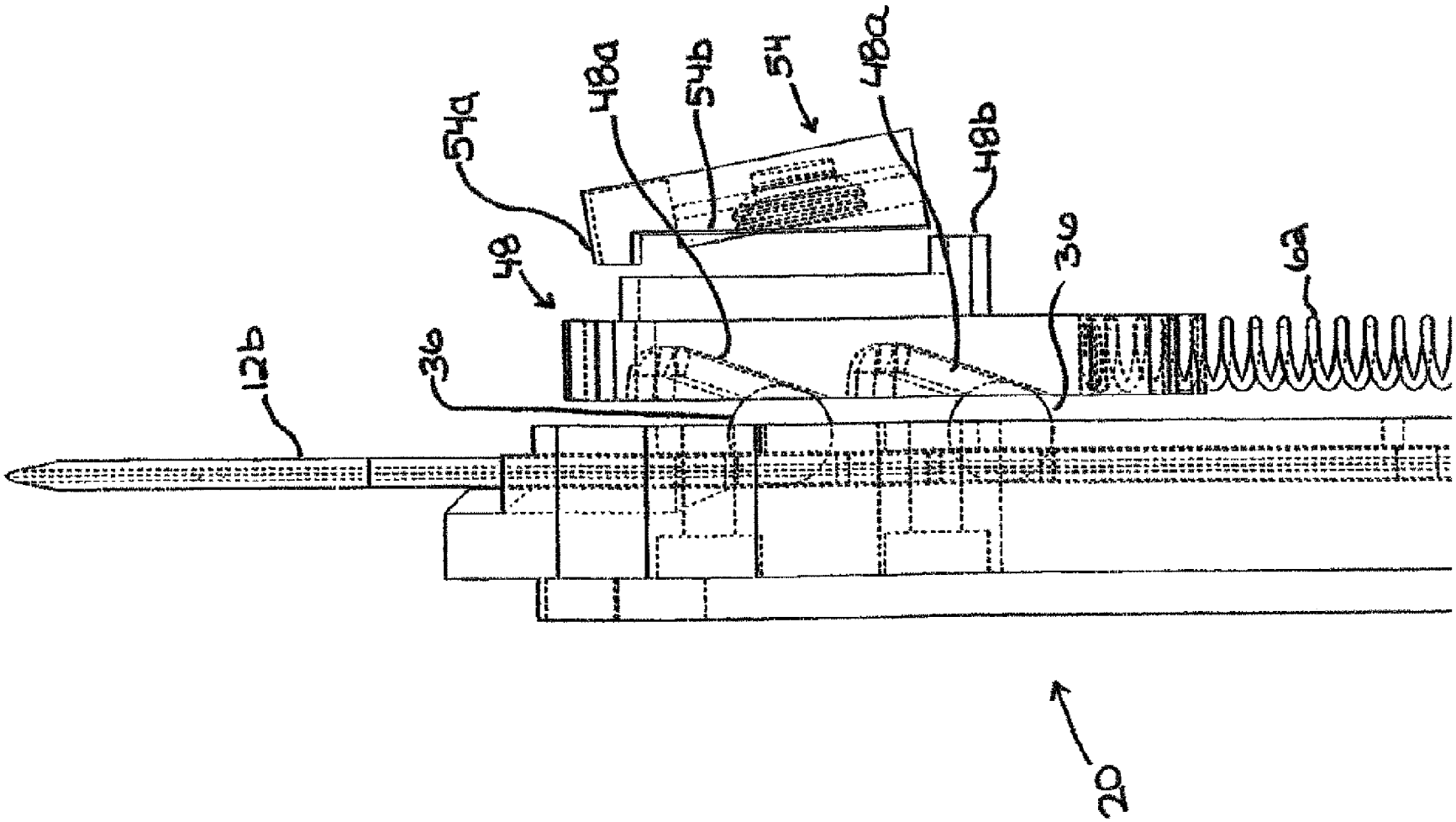
FIG. 8 is, in partially cut-away top perspective view, a blade carrier and blade release mechanism according to the present invention.
Figures 9, 9A, 9B, 9C:
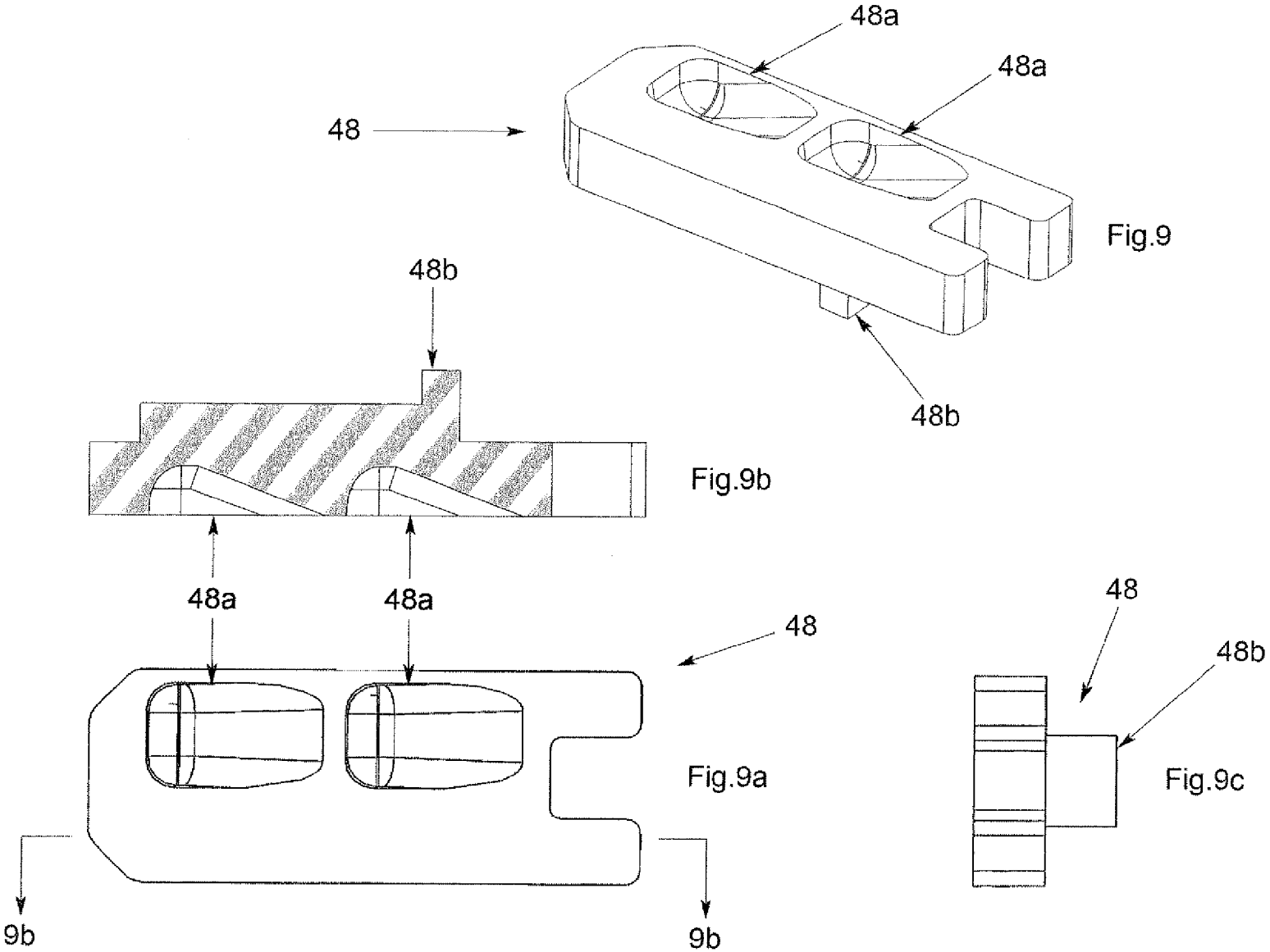
FIG. 9 is, in perspective view, the blade locking ball slide of the blade release mechanism according to the present invention.
FIG. 9*a* is, in plan view, the ball slide of FIG. 9.
FIG. 9*b* is, in a sectional view along line 9*b*-9*b* in FIG. 9*a*.
FIG. 9*c* is, in end elevation view, the ball slide of FIG. 9.
Figure 10:
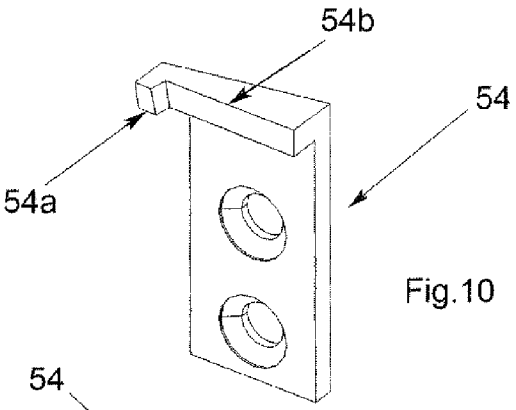
FIG. 10 is, in perspective view, the switch slide retainer of the blade release mechanism according to the present invention.
Figure 10B:
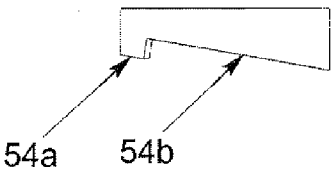
FIG. 10*b* is, in plan view, the slide retainer of FIG. 10.
Figure 10A:
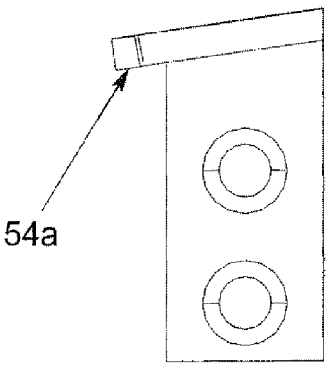
FIG. 10*a* is, in front elevation view, the slide retainer of FIG. 10.
Figure 10C:
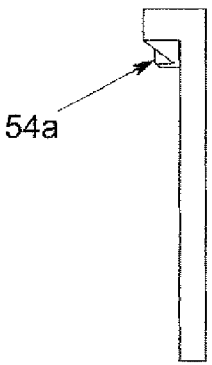
FIG. 10*c* is, in end elevation view, the slide retainer of FIG. 10.
Figure 11:
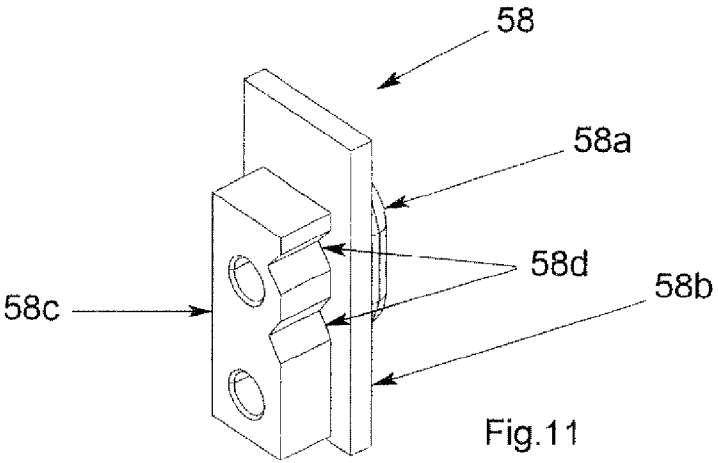
FIG. 11 is, in perspective view, the switch slide button of the blade release mechanism according to the present invention.
Figure 11B:
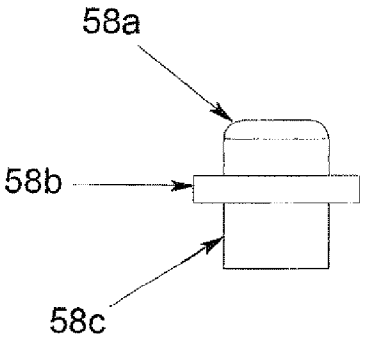
FIG. 11*b* is, in plan view, the slide button of FIG. 11.
Figure 11D:
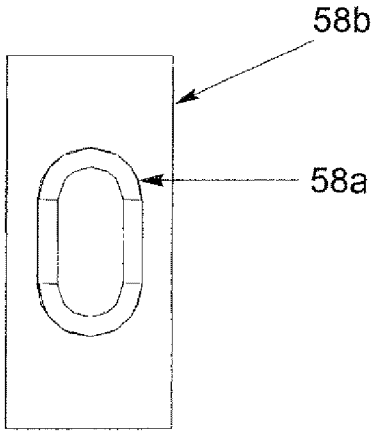
FIG. 11*d* is, the side elevation view of the side opposite to FIG. 11*a* of the slide button of FIG. 11.
Figure 11C:
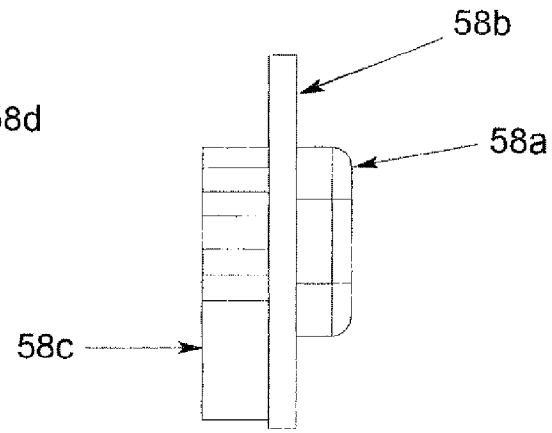
FIG. 11*c* is, in end elevation view, the slide button of FIG. 11.
Figure 11A:
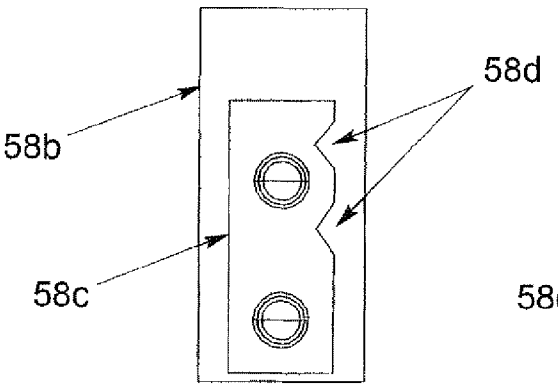
FIG. 11*a* is, in front elevation view, the slide button of FIG. 11.
Figure 12:
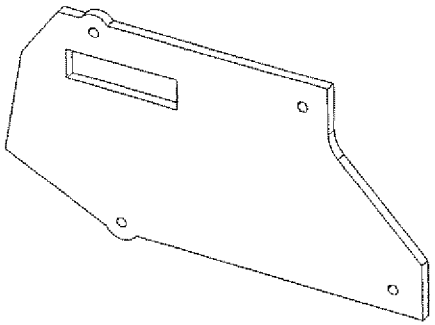
FIG. 12 is, in perspective view, the blade locking slide retainer of the blade release mechanism according to the present invention.
Figure 12B:
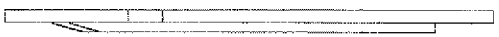
FIG. 12*b* is, in plan view, the slide retainer of FIG. 12.
Figure 12A:
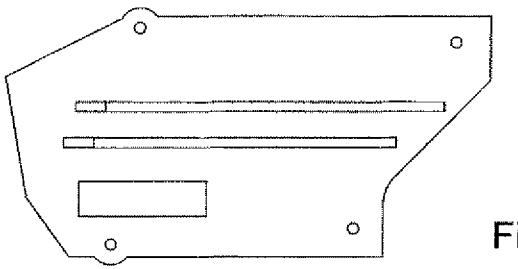
FIG. 12*a* is, in front elevation view, the slide retainer of FIG. 12.
Figure 12C:
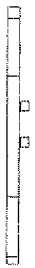
FIG. 12*c* is, in end elevation view, the slide retainer of FIG. 12.
Figure 13:
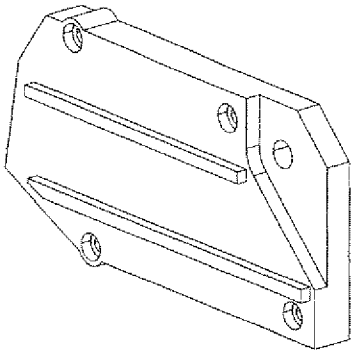
FIG. 13 is, in perspective view, the blade carrier, left-side, of the blade release mechanism according to the present invention.
Figure 13B:
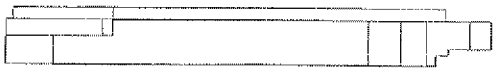
FIG. 13*b* is, in plan view, the blade carrier of FIG. 13.
Figure 13A:
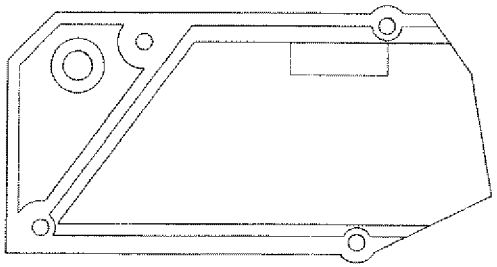
FIG. 13*a* is, in side elevation view, the blade carrier of FIG. 13.
Figure 13C:
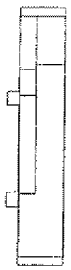
FIG. 13*c* is, in end elevation view, the blade carrier of FIG. 13.
Figure 14:
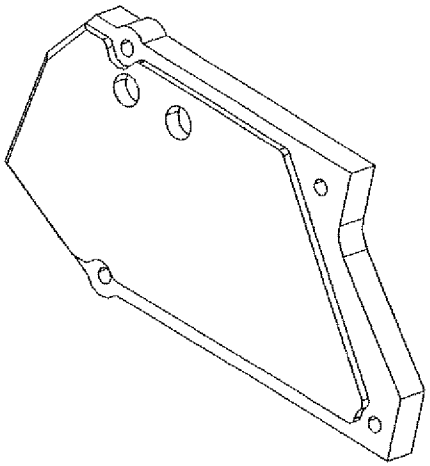
FIG. 14 is, in perspective view, the blade carrier, right-side, of the blade release mechanism according to the present invention.
Figure 14B:
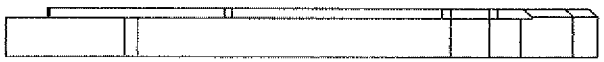
FIG. 14*b* is, in plan view, the blade carrier of FIG. 14.
Figure 14A:
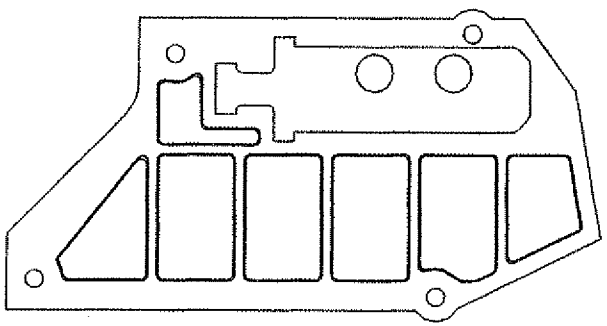
FIG. 14*a* is, a side elevation view of the blade carrier of FIG. 14.
Figure 14C:
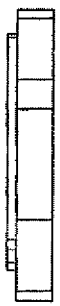
FIG. 14*c* is, in end elevation view, the blade carrier of FIG. 14.

The present invention is an improved mechanism for locking and changing the blades a utility knife for example of the kind used as a wallboard cutting tool for scoring or cutting of wallboard panels. The blades are housed within a handle body, herein also referred to as cutting head 8. The cutting head is pivoted to expose one of the blades or knives 12 (alternatively referred to herein as knives or blades) and then is drawn across the surface of the wallboard at a fixed distance from the wallboard edge, resulting in a cut or score-line being made in the wallboard surface. The cutting head 8 is mounted on a base 10 which includes a rocker stand 16. The base 10 is slidably mounted on T-Square 6 having a ruler arm 6*a*, and adjustably located and locked in position along the T-Square arm using a quick lock such as a cam lock 28. The T-Square fence 6*b* is slid along, in contact with, the wallboard edge thereby maintaining constant the distance between the knife or blade 12 and wallboard edge as the blade is drawn across the wallboard surface. The cutting locations of the knife blades 12 in cutter head 8 can be accurately fixed relative to the reference face of the T-Square fence 6*b* by adjusting the cutter base 10 to locations 6*c* marked on the T-Square arm 6*a* by aligning indicia pointers on the cutter base 10 with the identical indicia markings on opposite edges of T-Square arm 6*a*.

The cutting head 8 is shaped to provide a handle. Head 8 contains two knife blades 12 within the same cutting plane but oppositely positioned at opposite ends of the cutting head. Each blade 12 is slidably mounted in corresponding opposite ends of the cutting head and each is linked to the cutter head base 10 by linkage arms 14 pivotally mounted on pins 14*b* on opposite ends of triangular rocker stand 16. Stand 16 is composed of halves 16*a* and 16*b* mounted down onto the basals slide portion of base 10. Base 10 includes a parallel, opposed facing pair of channels 40*a* in base rail 40 which are sized for a snug sliding interlocking there along the opposite sides of T-square arm 6*a*.

Arms 14 may be a lamination or sandwich of arcuate plates 14*a*. Head 8, in particular flange 8*a*, is pivotally mounted by pivot pin 18 or other pivot mount member onto the apex 16*c* of stand 16. Head 8 rotates about pivot pin 18 in direction A by a user applying a downward pressure such as force F to either end of head 8 that is, offset from pivot pin 18. Rotating head 8 in direction A about pin 18 causes each arm 14 to drive its corresponding blade carrier 20, to which it is pivotally mounted, in direction B. On the end of head 8 which is rotated downwardly by force F, arm 14 drives corresponding carrier 20 in corresponding direction B and thereby translates force F into travel of corresponding knife 12 also in direction B that is, generally orthogonally to the direction of force F. Knives 12 are sandwiched between the opposite side panels of and thereby rigidly held by each corresponding blade carrier 20.

Rotation of head 8 in direction A alternatively flexes or relaxes spring arms 22*a* of spring 22. The springs 22 are mounted on apex 16*c* to bias spring arms 22*a* upwardly into resiliently biasing engagement against the underside of the upper surfaces 24*a* of clamshell casings 24. As a first blade 12 is being extended in corresponding direction B from slots 26 formed between the opposed facing ends of casings 24, the other blade 12 (the second blade) under the influence of its corresponding return spring arm 22*a* and linkage arm 14, is carried in its corresponding blade carrier 20 so as to also slide in direction B until reaching the limit of the travel limit of its downward arc C about corresponding pin 14*b*. Arc C is of sufficient length so that, as head 8 continues to rotate in direction A, at or near the end of the rotation of head 8 the first knife 12 only then extends a short distance from the downwardly disposed end of head 8 while maintaining the second knife 12 in its retracted position within head 8.

The opposite resilient urging of spring arms 22*a* returns cutting head 8 housing automatically to its neutral (knives retracted) level position when force F, that is the downward pressure of the operator's hand, is removed.

Cutter head 8 may in a preferred embodiment include a backbone 30 comprising halves 30*a*, 30*b*, which, when assembled together, sandwich blade carriers 20 between the channels 32 in halves 30*a*, 30*b*. Both side panels of blade carriers 20 have longitudinally extending rails 34 for sliding mating into correspondingly sized longitudinally extending channels 32 mounted or formed on the substantially planar, opposed-facing interior side walls of backbone halves 30*a*, 30*b*.

Each blade or knife 12 has upper notches 12*a* which mate, as better described below, with locking balls 36 within blade carrier 20 so that blade 12 is held rigidly in a releasable mounting within carrier 20. Thus with blade 12 mounted within carrier 20 so as to extend one of the reversible cutting ends 12*b* from slot 26, the opposite closed end of carrier 20 is held between the channels 32 sliding on rails 34 and constrained in sliding translation in direction B by the mechanical linkage of carrier end 15 of arm 14 pivotally mounted in aperture 20*a* in carrier 20. The carrier end 15 of arm 14 is rotatably pinned to aperture 20*a* by pin 14*c*. The opposite end is pinned to rocker stand 16. Thus arms 14 are free to rotate in the plane containing knives 12 relative to both base 10 and blade carriers 20. Blade carriers 20 are in their inward retracted positions when cutting head 8 is in its neutral position, that is, not having either of its ends rotated downwardly about rocker stand 16.

As described above, springs 22, provide the return biasing force biasing the blade carriers 20 to translate inwardly in towards the pivot mount of cutting head 8 on rocker stand 16 which as illustrated may be in the form of an upstanding generally equilateral triangle having a rounded upper vertice or apex 16*c*.

Storage compartment 38 is formed in each of clamshell casings 24 for spare blade storage of a plurality of spare knives and accessed by door 38*a*.

Blade carrier 20 includes a carrier frame 42 sandwiched between a bearing plate 44 and a switch plate 46. Carrier frame 42 has a horizontally disposed pair of apertures 42*a*. Each aperture 42*a* is sized to allow one of locking balls 36 to snugly pass therethrough. Thus locking balls 36 are free to translate laterally relative to carrier 20 in both directions H so as to mate snugly into notches 12*a* in knife blade 12, and once so mated to bear against bearing surface 44*a* of bearing plate 44, and in direction I so as to pass through apertures 42*a* in carrier frame 42.

Carrier frame 42 also includes a channel 42*b* in which is slidably mounted a locking slide 48. Channel 42*b* overlies apertures 42*a*. Locking slide 48 is free to slide in direction J in channel 42*b* against the return biasing force of resilient spring 50 mounted in a channel extension 42*c*. Locking slide 48 has a pair of pockets 48*a* on the side of the slide facing the bottom surface of channel 42*b* and directly overlying apertures 42*a*. Pockets 48*a* having sloped bottom surfaces, are elongate in a direction parallel to direction J, and are sized so that: (a) with slide 48 in a locking position with spring 50 extended (that is, slid in channel 42*b* in a direction opposite to direction J), apertures 42*a* are aligned with the most shallow end of pockets 48*a*; and, (b) with slide 48 in an unlocking position with spring 50 compressed and slide 48 slid in direction J in channel 42*b*, apertures 42*a* are aligned with the deepest end of pockets 48*a*.

Thus with slide 48 in the locking position locking balls 36 are held by slide 48 biased in direction H through apertures 42*a* and through notches 12*a* in knives 12 to bear locking balls 36 against bearing surface 44*a*. Consequently knives 12 are held rigidly in position within carrier 20. However, when slide 48 is in the unlocking position, locking balls 36 are free to translate in direction I through apertures 42*a* so as to deeply seat in pockets 48*a* thereby translating completely clear of notches 12*a*. With locking balls 36 clear of notches 12*a*, knives 12 may be slid in direction K relative to so as to be slid out from between frame 42 and bearing plate 44 and through slots 26 so that knives 12 may be reversed or changed completely for spare knives from compartment 38.

A lock switch 52 is provided to selectively lock slide 48 in its locking position thereby locking knives 12 in place. Switch 52 in a preferred embodiment includes a vertically translatable bar 54 which translates in direction L perpendicularly to the sliding of slide 48 in direction J. Bar 54 is slidably mounted on the inner side of backbone halve 30*a* aligned with vertical slot 56. Thumb switch 58 is mounted in slot 56 so that slide knob 58*a* protrudes outwardly of the outside of backbone halve 30*a* so as to be aligned with and protrude through slot 24*b* in the corresponding casing 24. Plate 58*b* slides over the rim of slot 56 sandwiched between backbone halve 30*a* and corresponding casing 24.

Notched tab 58*c* is mounted to the inner side of plate 58*b*, that is, the side opposite to knob 58*a* and is sized to fit into slot 56 so as to allow a small amount of vertical travel of tab 58*c* within slot 56. Bar 54 is mounted by fasteners 60 to tab 58*c* so as to sandwich the wall of backbone halve 30*a* between bar 54 and plate 58*b* while allowing free vertical translation in direction L of the combination of bar 54 and thumb switch 58, constrained by the travel of tab 58*c* in slot 56.

Two notches 58*d* are formed on one side of tab 58*c*. A spring 62 mounted in a channel perpendicular to and adjoining slot 56 resiliently urges a ball 64 into one of notches 58*d*; the upper of the two notches when thumb switch 58 is in its lowered position and the lower of the two notches when thumb switch 58 is slid upwardly into its raised position. Ball 64 serves to retain thumb switch 58 in its raised or lowered position.

When thumb switch is elevated into its raised position, thereby correspondingly elevating bar 54, hook stop 54*a* on flange 54*b* is elevated into the path of hook 48*b*. Thus when carrier 20 is driven forwardly in direction B by the rocker arm downward deflection of cutting head 8, hook 48*b* protruding through slot 46*a* in switch plate 46 snags against hook stop 54*a* thereby causing slide 48 to translate in direction J relative to carrier frame 42 against spring 50. This releases locking balls 36 to translate in direction I into pockets 48*a* and thereby unlocking knife 12 held in its carrier 20. With cutting head 8 held with its corresponding end depressed downwardly, the unlocked knife 12 may be extracted through slot 26 and replaced through slot 26. With a knife replaced back through slot 26 so as to align notches 12*a* with balls 36, the downwardly depressed end of cutting head 8 may be released to return cutting head 8 to its neutral position as urged by springs 22. This releases hook 48*b* from its engagement with hook stop 54*a* and returns slide 48 to its position locking balls 36 into notches 12*a*. Returning thumb switch to its lowered position allows cutting head 8 to be operated to extend knives 12 during normal operation.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A utility knife blade release and locking mechanism comprising:

a blade locking ball slide having at least one pocket formed thereon, at least one locking ball mounted alongside said ball slide, said ball slide slidably mounted in a blade carrier for sliding translation relative to said blade carrier, said blade carrier adapted to hold a blade having at least one ball receiving aperture therein alongside said at least one locking ball so as to sandwich said at least one locking ball between the blade when held in said blade carrier and said ball slide, said ball slide positionable into ball locking and ball unlocking positions, said at least one pocket mis-aligned with said at least one locking ball when said ball slide is in said ball locking position so that said at least one locking ball is held in registry into the at least one ball receiving aperture of the blade when held in said blade carrier, and wherein said at least one pocket is aligned with said at least one locking ball when said ball slide is in said ball unlocking position so that said at least one locking ball is received into said at least one pocket, whereby said at least one locking ball is released from the at least one aperture in the blade when held in said blade carrier so that the blade is unlocked and removable from said blade carrier, a selectively positionable switch slide retainer positionable into a ball slide engaging position and a ball slide disengaged position, wherein in said ball slide engaging position said switch slide retainer engages said ball slide so as to bias the position of said at least one pocket into said ball unlocking position from said ball locking position.

2. The mechanism of claim 1 wherein said ball slide is adapted to slide in a first translation direction along a length of said blade carrier so as to slide adjacent and parallel to the blade when held in said blade carrier, and wherein said slide retainer is adapted to slide in a second translation direction which is substantially also adjacent and parallel to a plane containing said first translation direction, and wherein said second translation direction intersects said first translation direction so that said slide retainer has been translated in said second translation direction into a slide blocking position so as to block translation of said ball slide in said first translation direction thereby biasing said ball slide into said ball unlocking position.

3. The mechanism of claim 2 wherein said second translation direction is substantially orthogonal to said first translation direction.

4. The mechanism of claim 3 wherein said slide retainer includes a latching member which engages against said ball slide when said slide retainer is in said slide blocking position.

5. The mechanism of claim 4 wherein said ball slide is elongate in said first translation direction, having a forward end towards said first translation direction and an opposite reward end, and wherein said ball slide is adapted to engage said latching member towards said rearward end.

6. The mechanism of claim 5 further comprising:

a rocker housing pivotally mounted about a pivot mount on a base;

an oppositely disposed pair of said blade carriers slidably mounted in oppositely disposed coplanar array within a corresponding pair of cavities in said rocker housing, said pivot mount between said pair of cavities, a drive linkage mounted so as to cooperate between said base and said blade carriers alternatingly to: drive a cutting end of a first blade held in a first blade carrier of said blade carriers from said rocker housing in a first direction upon pivoting of a corresponding first side of said rocker housing downwardly and retain a second blade carrier of said blade carriers within said rocker housing; or, to drive a cutting end of a second blade from said rocker housing in a second direction opposite said first direction upon pivoting of a corresponding second side of said rocker housing, opposite said first side, downwardly and retain said first blade carrier within said rocker housing, wherein when said first side of said rocker housing is pivoted downwardly about said pivot mount said first blade carrier is rotated correspondingly downwardly while being driven in said first direction by said drive linkage so that said cutting end of said first blade held in said first blade carrier only extends from said first end side of said rocker housing upon said pivoting downwardly of said first side of said housing into a first lowermost pivoted position and wherein when said second side of said rocker housing is pivoted downwardly about said pivot mount said second blade carrier is rotated correspondingly downwardly while being driven in said second direction by said drive linkage so that said cutting end of said second blade held in said second blade carrier only extends from said second side of said rocker housing upon said pivoting downwardly of said second side of said housing into a second lowermost pivoted position, and wherein said blade locking ball slide, said at least one locking ball, said switch slide retainer corresponding to each said blade carrier are mounted in said rocker housing, and wherein, when said slide retainer corresponding to one of said blade carriers is in said blocking position, a corresponding said ball slide engages a corresponding said latching member as said rocker housing is pivoted into corresponding said first or second lowermost pivoted position, so that the corresponding said first or second blade held in the corresponding said first or second blade carrier is only unlocked as the corresponding said cutting end is extended from the corresponding said first or second side of said rocker housing.

7. The mechanism of claim 6 further comprising first resilient biasing device mounted in said housing that biases said blade carriers inwardly of said housing into corresponding said cavities, and so as to return said housing to a neutral position wherein neither said first or second side of said housing is downwardly pivoted, and wherein when said housing is in said neutral position, said first translation direction is substantially horizontal and said second translation direction is substantially vertical, and wherein said mechanism further comprises a manually operable switch on said housing or biasing said slide retainer in said second translation direction.

8. The mechanism of claim 7 further comprising a second resilient biasing device that biases said ball slide into said ball locking position when said ball slide is not engaged by said slide retainer in said blocking position.

9. The mechanism of claim 8 further comprising a manually operable lock releasably engaging said slide retainer with said rocker housing, wherein said lock releasably engages said slide retainer in positions in and out of said blocking position.

10. The mechanism of claim 9 wherein said lock includes a resiliently biased latch engaging corresponding detents corresponding to said positions in said positions in and out of said blocking position.

11. The mechanism of claim 8 wherein said cavities are elongate so as to extend between oppositely disposed first and second openings in corresponding said first and second sides of said housing and wherein said first resilient biasing device includes at least one spring, and wherein said drive linkage urges said first or second blade carriers linearly along said corresponding first or and second cavities upon corresponding said downward pivoting of said first and second ends-sides of said housing against the return biasing force of said first resilient biasing device.

12. The mechanism of claim 11 wherein said drive linkage includes first and second drive arms rotatably mounted at first ends thereof to said base and rotatably mounted at opposite second ends thereof to said first and second blade carriers respectively.

13. The mechanism of claim 12 wherein said drive arms are elongate and wherein said pivot mount includes a pivot member extending between said base and said housing and wherein said first ends of said drive arms are rotatably mounted on opposite adjacent sides of, and below, said pivot member.

14. The mechanism of claim 13 wherein said housing is elongate so as to extend and be elongate between said first and second openings so that said housing forms an elongate handle extending longitudinally along its length orthogonally from said axis of rotation.

15. The mechanism of claim 14 wherein said first and second openings are at outermost distal ends of said first and second sides of said housing.

16. The mechanism of claim 15 wherein said first and second blade carriers includes said first and second blades removably mounted therein so as to be carried in their corresponding said first and second blade carriers when mounted slidably in corresponding said first and second cavities for sliding linear translation along said first and second cavities in oppositely disposed said first and second directions substantially radially outwardly of said pivot member.

* * * * *